US010760881B2

(12) United States Patent
Miklaszewski et al.

(10) Patent No.: US 10,760,881 B2
(45) Date of Patent: Sep. 1, 2020

(54) SYSTEMS AND METHODS FOR MODIFYING AND ENHANCING PYROTECHNIC EMISSIONS AND EFFECTS BY IRRADIATING PYROTECHNIC EMISSIONS USING ELECTROMAGNETIC RADIATION SOURCES WITH PROGRAMMABLE ELECTROMAGNETIC RADIATION PROFILES

(71) Applicant: The United States of America, as represented by the Secretary of the Navy, Crane, IN (US)

(72) Inventors: Eric J Miklaszewski, Bloomington, IN (US); Jonathan M. Dilger, Bloomington, IN (US); Travis R. Sippel, Ames, IA (US); James B. Michael, Ames, IA (US); Stuart Barkley, Ames, IA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 207 days.

(21) Appl. No.: 15/953,040

(22) Filed: Apr. 13, 2018

(65) Prior Publication Data

US 2018/0299236 A1 Oct. 18, 2018

Related U.S. Application Data

(60) Provisional application No. 62/485,088, filed on Apr. 13, 2017.

(51) Int. Cl.
*F42B 4/00* (2006.01)
*F42B 4/04* (2006.01)
(Continued)

(52) U.S. Cl.
CPC ..... *F42B 4/00* (2013.01); *F42B 4/04* (2013.01); *H01F 7/20* (2013.01); *H01F 27/28* (2013.01);
(Continued)

(58) Field of Classification Search
CPC ..... F24B 4/04; F24B 4/26; H01F 7/20; F42B 4/00
See application file for complete search history.

(56) References Cited

U.S. PATENT DOCUMENTS 8,981,261 B1 3/2015 Tillotson
9,429,398 B2 * 8/2016 Cortelyou ..... F42B 4/00
(Continued)

*Primary Examiner* — Edelmira Bosques
*Assistant Examiner* — Nikhil P Mashruwala
(74) *Attorney, Agent, or Firm* — Naval Surface Warfare Center, Crane Division; Eric VanWiltenburg

(57) ABSTRACT

Exemplary systems and methods for modifying and enhancing pyrotechnic emissions and effects are provided including systems for irradiating pyrotechnic emissions using electromagnetic radiation sources with programmable electromagnetic radiation profiles. Exemplary systems include coupling an electromagnetic radiation source to a pyrotechnic device to irradiate pyrotechnic emissions or irradiating pyrotechnic emissions with an external electromagnetic radiation source. Exemplary methods include identifying a desired pyrotechnic emission output and designing an emission and effect output to meet the desired output.

13 Claims, 7 Drawing Sheets

(51) Int. Cl.

| | |
|---|---|
| ***H01F 7/20*** | (2006.01) |
| ***F42B 4/26*** | (2006.01) |
| ***H05H 1/16*** | (2006.01) |
| ***H01F 38/14*** | (2006.01) |
| ***H01F 27/28*** | (2006.01) |
| ***H05H 1/46*** | (2006.01) |

(52) U.S. Cl.
CPC ..... *H01F 38/14* (2013.01); *H05H 1/16* (2013.01); *H05H 1/46* (2013.01); *F42B 4/26* (2013.01); *H05H 2001/463* (2013.01); *H05H 2001/466* (2013.01); *H05H 2001/4667* (2013.01)

(56) References Cited

U.S. PATENT DOCUMENTS

| | | | | |
|---|---|---|---|---|
| 9,533,237 | B2 * | 1/2017 | Testa | A63J 5/04 |
| 10,061,058 | B2 * | 8/2018 | Cortelyou | G06K 9/00771 |
| 10,173,944 | B2 * | 1/2019 | Nielson | C06C 15/00 |
| 2006/0011083 | A1 | 1/2006 | Perry | |
| 2007/0068053 | A1 * | 3/2007 | Troitski | F42B 4/00 40/442 |
| 2015/0338196 | A1 * | 11/2015 | Cortelyou | H04N 7/183 700/253 |
| 2019/0169082 | A1 * | 6/2019 | Nielson | C06C 15/00 |

* cited by examiner

SYSTEMS AND METHODS FOR MODIFYING AND ENHANCING PYROTECHNIC EMISSIONS AND EFFECTS BY IRRADIATING PYROTECHNIC EMISSIONS USING ELECTROMAGNETIC RADIATION SOURCES WITH PROGRAMMABLE ELECTROMAGNETIC RADIATION PROFILES

CROSS-REFERENCE TO RELATED APPLICATIONS

This patent application claims the benefit of U.S. Provisional Application No. 62/485,088, titled SYSTEMS AND METHODS FOR MODIFYING AND ENHANCING PYROTECHNIC EMISSIONS AND EFFECTS BY IRRADIATING PYROTECHNIC EMISSIONS USING ELECTROMAGNETIC RADIATION SOURCES WITH PROGRAMMABLE ELECTROMAGNETIC RADIATION PROFILES, filed Apr. 13, 2017, the disclosure of which is expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon. This invention (Navy Case 200,410) is assigned to the United States Government and is available for licensing for commercial purposes. Licensing and technical inquiries may be directed to the Technology Transfer Office, Naval Surface Warfare Center Crane, email: Cran_CTO@navy.mil. This invention was made with government support under grant nos. FA9550-15-1-0195 and FA9550-15-1-0481 awarded by the United States Air Force Office of Scientific Research. The government has certain rights in the invention.

BACKGROUND AND SUMMARY OF THE INVENTION

The present invention relates to systems and methods for modifying the emissions and effects output of a pyrotechnic device by exposing the pyrotechnic device's emissions to electromagnetic radiation.

Most pyrotechnic devices rely on exothermic chemical interactions created by combining an oxidizer with a fuel source, known as a pyrotechnic composition. The chemical reactions can create a combination of heat, light, sounds, and gas based on the pyrotechnic composition within the device. Photonic emissions are released in the flame of a pyrotechnic device as a result of the relaxation of excited electrons returning to their ground state and releasing their quantized energy. A pyrotechnic composition can be adjusted to meet individual performance requirements such as desired light emissions across the electromagnetic spectrum, adiabatic flame temperature, dominant wavelength, and spectral emission purity. However, the process of adjusting the pyrotechnic composition is time intensive; additionally, the possible emission and effect profiles of pyrotechnic devices are limited by the electronic transition energies of atomic and molecular emissions produced by the chemical reactions. Adjusting the pyrotechnic composition cannot efficiently augment or amplify electron excitation pathways or access new excitation pathways, severely limiting the variety of emission and effect profiles. Once a pyrotechnic composition has been created, changes to the emission and effect profile cannot be made without changing the pyrotechnic composition.

To solve these problems, embodiments of this invention disclose the application of electromagnetic radiation (EMR) to the flame of a pyrotechnic device to allow much greater variety in emission and effect profiles without the need to change the pyrotechnic composition. Irradiating pyrotechnic emissions causes additional excitation of electrons within the irradiated area (e.g. additional excited electrons or further excitation of previously excited electrons). When these electrons relax to a lower state, the resulting photons can augment or amplify the normal pyrotechnic emissions. By irradiating the emissions with specific frequencies and durations of EMR, the size of emission flames and plasma, the electromagnetic emissions, the dominant wavelength of emissions, and spectral purity of emissions can be discretely controlled. Applying a series of varying EMR can produce a multitude of effects over the course of a single pyrotechnic event.

According to an illustrative embodiment of the present disclosure, a pyrotechnic device can be irradiated by an external EMR source which is not coupled to the pyrotechnic device. The external EMR source can generate EMR directed towards a specific point with a discrete EMR source (e.g. a laser) or towards a region with an area of effect EMR source (e.g. a RF transmitter). Varying the frequency, amplitude, and/or flux of the generated EMR can affect the pyrotechnic emissions (e.g. dominant wavelength, spectral purity, brightness) of the pyrotechnic device while varying the duration of transmission (e.g. continuous transmission for a particular duration, a series of pulses) of the EMR can affect the pyrotechnic effects (e.g. creating patterns or designs). To tailor EMR output to create a desired emission and effect profile, programmable hardware within the external source can transmit a plurality of EMR of various frequencies, power levels, and durations of transmission.

According to a further illustrative embodiment of the present disclosure, an EMR source can be coupled to a pyrotechnic device. A coupled EMR source can include an independent power source to allow the system to remain portable. In some embodiments, the coupled EMR source creates a localized electromagnetic field (EMF) across the pyrotechnic emissions to irradiate the emissions.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
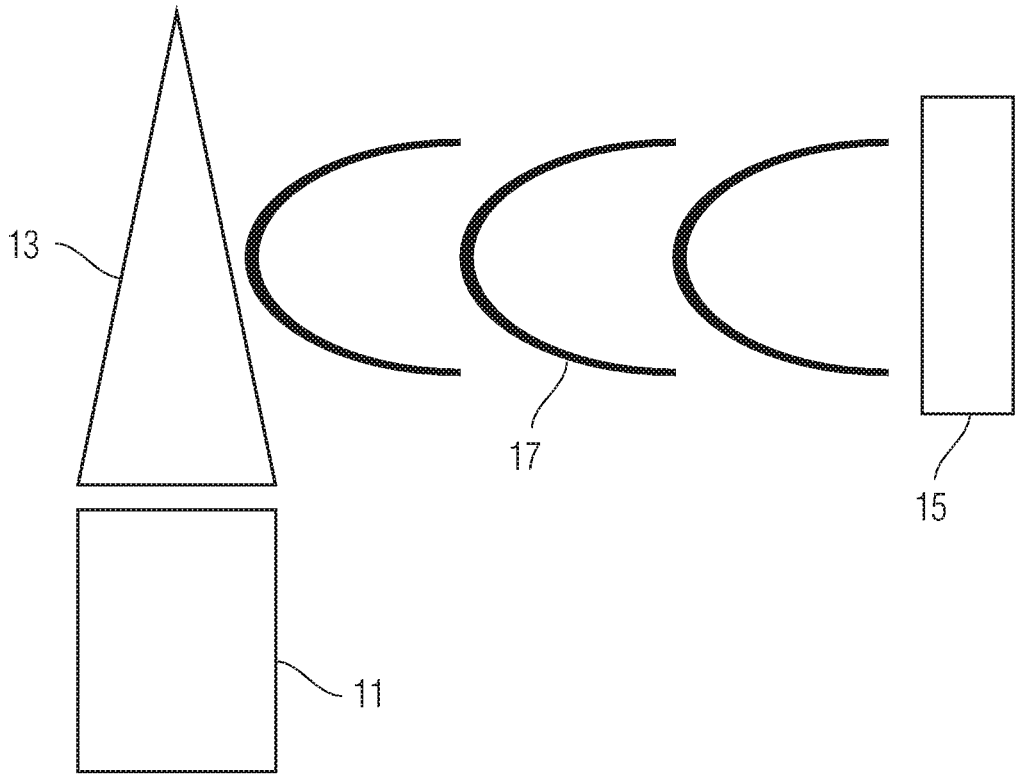
FIG. 1 shows an exemplary system for irradiating pyrotechnic emissions with an external EMR source.

Referring initially to FIG. 1, an exemplary system for irradiating pyrotechnic emissions is shown. A pyrotechnic device 11 (e.g., a flare, a firework, a match) generates pyrotechnic emissions 13 (e.g. a flame, plasma, secondary EMR) and an external EMR source 15 (e.g. a microwave magnetron or an RF antenna) generates output EMR 17 (e.g. microwaves, radio waves, ultraviolet radiation, visible light. In some embodiments, the pyrotechnic device 11 includes a casing or body and a pyrotechnic composition. The pyrotechnic composition can include an alkali, alkaline-earth, or transition-metal compound (e.g. potassium nitrate), a halogen compound (e.g. polytetrafluoroethylene), or other combustible compositions. An EMR source 15 can direct output EMR 17 towards the pyrotechnic emissions 13 of the pyrotechnic device 11 to irradiate the emissions. An EMR source 15 can direct output EMR 17 through a cross sectional or volumetric area of pyrotechnic emissions 13 or to a discrete point within pyrotechnic emissions 13. In reaction to output EMR 17, the properties of pyrotechnic emissions 13 change, including an increase in the size of a flame or plasma (e.g. 50% increase in length), a change in the dominant frequency of visible light released (e.g. changing the dominant color of a flame from 700 nm light to 400 nm light) in the pyrotechnic emissions 13, a decrease in unwanted frequencies of secondary EMR to improve spectral purity of the pyrotechnic emissions 13, and prolongation of the duration of pyrotechnic emissions 13 (e.g. maintaining bright emissions for a longer period of time, sustaining plasma after a pyrotechnic device 11 ceases to produce emissions). An EMR source 15 can generate output EMR 17 continually for predetermined periods of time (e.g. constant generation over the lifetime of a pyrotechnic device's chemical reactions), for predetermined pulses (e.g. bursts of EMR generation for 10 ms with 10 ms pauses between each pulse), or other combinations of varying durations. Generated output EMR 17 can be a uniform wavelength or plurality of wavelengths (e.g. three predetermined and distinct electromagnetic frequencies) and can vary over time (e.g. cycle through a series of different frequencies). An EMR source 15 can generate output EMR 17 at a variety of power level (e.g. 1 kW, 50 kW) and can change the power output during operation to create different effects (e.g. rapid increases and decreases in power to create flashing or shimmering effects). Higher power levels can be used to increase the number of interactions between EMR 17 and pyrotechnic emissions 13 or to make up for photons scattered away from the pyrotechnic emissions 13 prior to interaction. Pluralities of wavelengths can be cycled for varying durations of time to create a dynamic system of changes to pyrotechnic emissions 13. A dynamic system of changes can cause a variety of effects (e.g., rapidly changing visible light wavelengths, varying brightest across pyrotechnic emissions 13 to cause changing shapes and patterns within the emissions) which can be stored in the EMR source 15 as an emission and effect profile.

Figure 2:
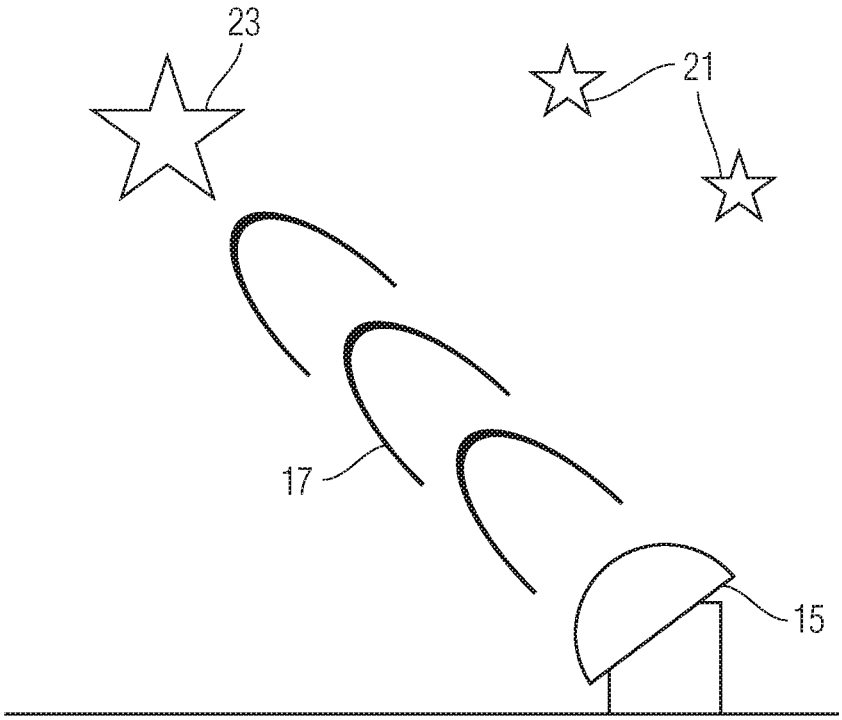
FIG. 2 shows an exemplary system for irradiating airborne pyrotechnic emissions with an external EMR source.

FIG. 2 shows another exemplary system for irradiating pyrotechnic emissions. Pyrotechnic devices (e.g., see 11, FIG. 1) are launched into the air and activated to release airborne pyrotechnic emissions 21 from the said pyrotechnic devices. An external EMR source 15 can irradiate airborne pyrotechnic emissions 21 to excite the electrons present within the airborne pyrotechnic emissions 21 to create augmented airborne pyrotechnic emissions 23. Augmented airborne pyrotechnic emissions 23 will then release photons when the electrons relax. Exemplary embodiments can use the system as shown in FIG. 1, including EMR source 15 and output EMR 17.

Figure 3A:
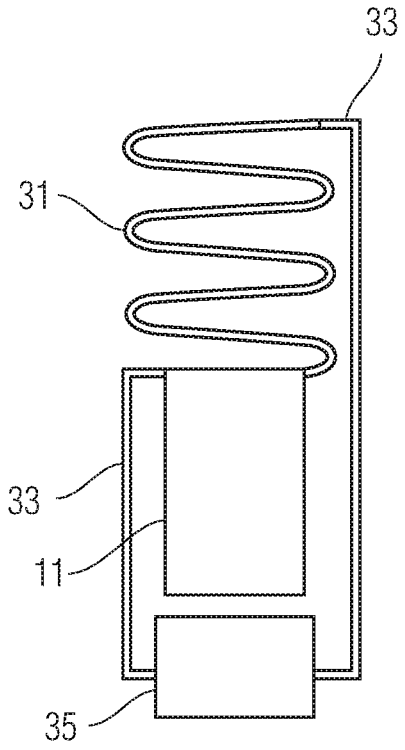
FIG. 3A shows an exemplary pre-ignition system for irradiating pyrotechnic emissions with an EMF inducing coil.
Figure 3B:
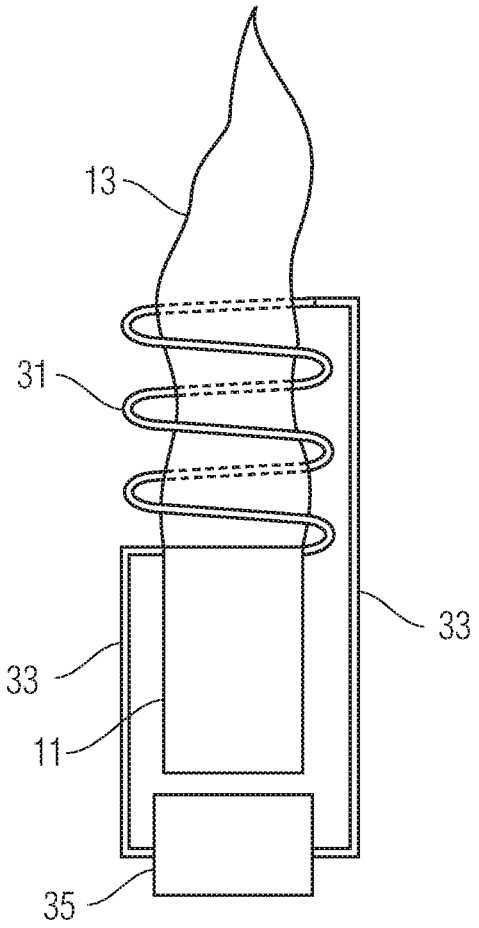
FIG. 3B shows an exemplary post-ignition system for irradiating pyrotechnic emissions with an EMF inducing coil.

FIG. 3A shows an exemplary pre-ignition system for using an inductive coil 31 as a source of EMR. In an exemplary embodiment, a power source 35 is coupled to a pyrotechnic device 11 and is electronically coupled to an inductive coil 31 with electrical cables 33. The inductive coil 31 forms rings around the emission path of the pyrotechnic device 11. The power source 35 creates a current through the inductive coil 31 which causes a localized electromagnetic field (EMF) to be created through an axis connecting the approximate centers of the loops or rings of the inductive coil 31. The inductive coil 31 can be positioned such that an EMF created by the inductive coil 31 can irradiate pyrotechnic emissions 13, as shown in FIG. 3B. FIG. 3B shows an exemplary embodiment of the same system after the pyrotechnic device 11 has been ignited. In exemplary embodiments, the coil can form loops in either a clockwise or counter-clockwise direction. In additional embodiments, the thickness of and spacing between the rings can vary. In an exemplary embodiment, the inductive coil 31 begins at the boundary between the pyrotechnic device 11 and the pyrotechnic emissions 13 and occupies the first ten percent of the height of pyrotechnic emissions 13 beyond that boundary.

Figure 4:
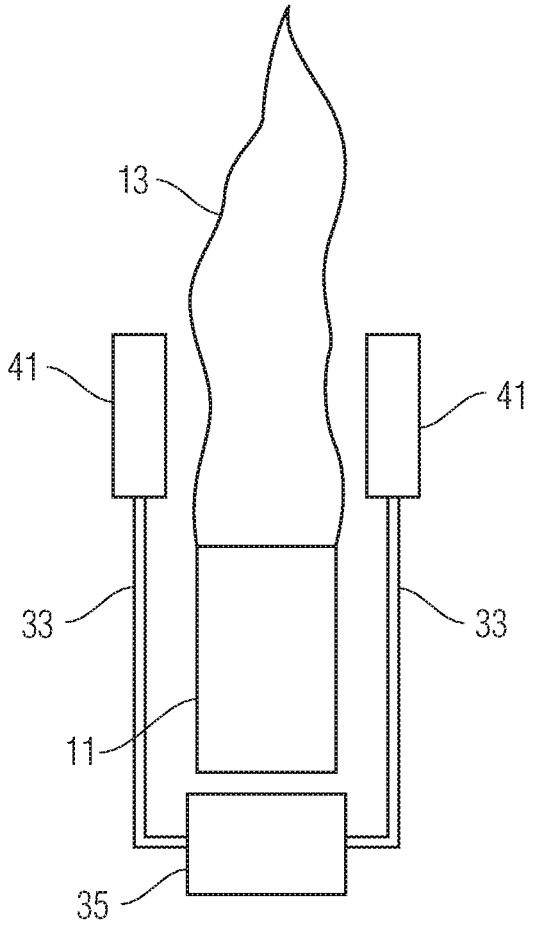
FIG. 4 shows an exemplary system for irradiating pyrotechnic emissions with a pair of EMF inducing plates.

FIG. 4 shows an exemplary system for using conductive plates 41 as a source of EMR. In an exemplary embodiment, a power source 35 is coupled to a pyrotechnic device 11 and is electronically coupled to a pair of conductive plates 41 with electrical cables 33. The power source 35 creates a positive charge in a first plate and a negative charge in a second plate which causes a localized EMF to form between the two plates. In exemplary embodiments, the conductive plates 41 are positioned such that the EMF can pass through and irradiate the pyrotechnic emissions 13.

Figure 5:
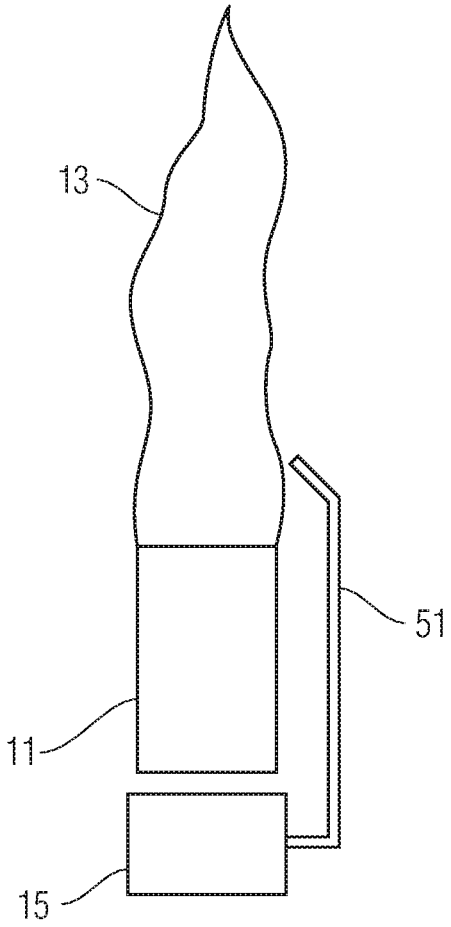
FIG. 5 shows an exemplary system for irradiating pyrotechnic emissions with a waveguide directing EMR from an EMR source to a flame.

FIG. 5 shows an exemplary system for using a waveguide 51 (e.g., a hollow metallic pipe, a fiber optic cable) to transfer EMR (not shown) from a coupled EMR source 15 to pyrotechnic emissions 13. In an exemplary embodiment, a coupled EMR source 15 (e.g. microwave generator, RF generator, laser generator) is coupled to a pyrotechnic device 11 and a waveguide 51. EMR created by a coupled EMR source 15 enters and exits a waveguide 51 such that the EMR is directed into the pyrotechnic emissions 13.

Figure 6:
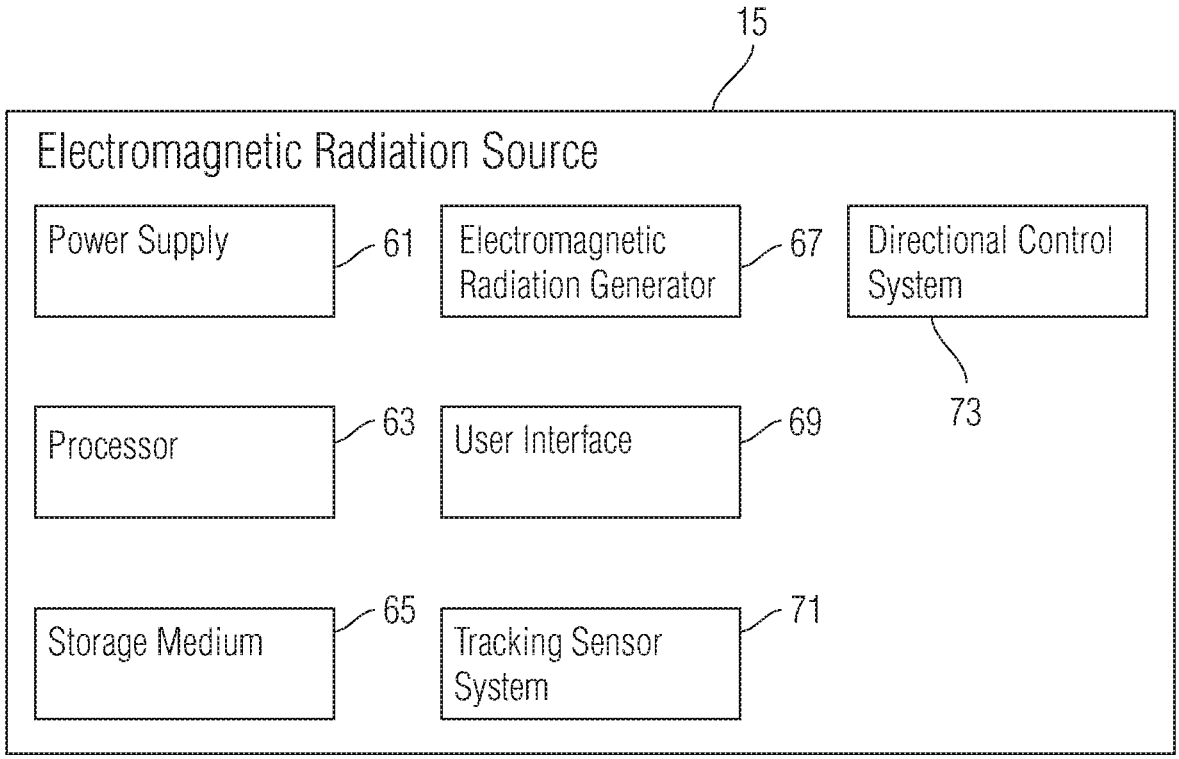
FIG. 6 shows an exemplary component structure of an exemplary EMR source.

FIG. 6 shows an exemplary component structure of an EMR source 15 that can be used in exemplary embodiments (e.g., as shown in FIGS. 1, 2, and 5). A power supply 61 can provide power to the systems and subsystems. A storage medium 65 (e.g. a HDD, flash memory) can be configured to store programmed emission and effect profiles (e.g. desired wavelength, desired luminous intensity, required output to create desired results, etc.) and tracking identification profiles (e.g. wavelengths of light to be tracked). A user interface 69 can be configured to allow an operator to enter an emission and effect profile and a tracking identification profile into the storage medium 65. A tracking sensor system 71 can detect and identify wavelengths of EMR with an EMR sensor (e.g. a RF receiver, a video camera) and generate a plurality of tracking signals identifying the location or direction of the source of the EMR (e.g. the direction from which the EMR was received) and the wavelength of the corresponding EMR (e.g. 700 nm light, 50 mm microwaves). In some embodiments, a processor 63 can be configured to compare a plurality of tracking signals to a tracking identification profile from the storage medium 65 to determine whether detected EMR matches a tracking identification profile, generate a plurality of directional control signals if a tracking signal matches a tracking identification profile, and transfer the plurality of directional control signals to a directional control system 73 (e.g. a two-axis rotational system capable of aiming along a $2\pi$ steradian solid angle). A directional control system 73 receiving directional control signals can use the signals to orient the EMR source 15 towards a location identified by a plurality of tracking signals. In additional embodiments, the directional control system 73 can avoid particular targets (e.g. a human, a stage prop) by including an optical sensor (e.g. a video camera) in the tracking sensor system 71 and including avoidance targets in a plurality of tracking signals for comparison against an avoidance profile. The processor 63 can be configured to generate a plurality of output signals corresponding to an emission and effect profile if a tracking signal matches the emission and effect profile, and transfer the plurality of output signals to an EMR generator 67. An EMR generator 67 receiving output signals can use the signals to generate output EMR (e.g., see 17, FIG. 1) specified in a corresponding emission and effect profile. In other embodiments, an operator can manually control a directional control system 73 to direct an EMR source 15 towards a chosen target.

Figure 7:
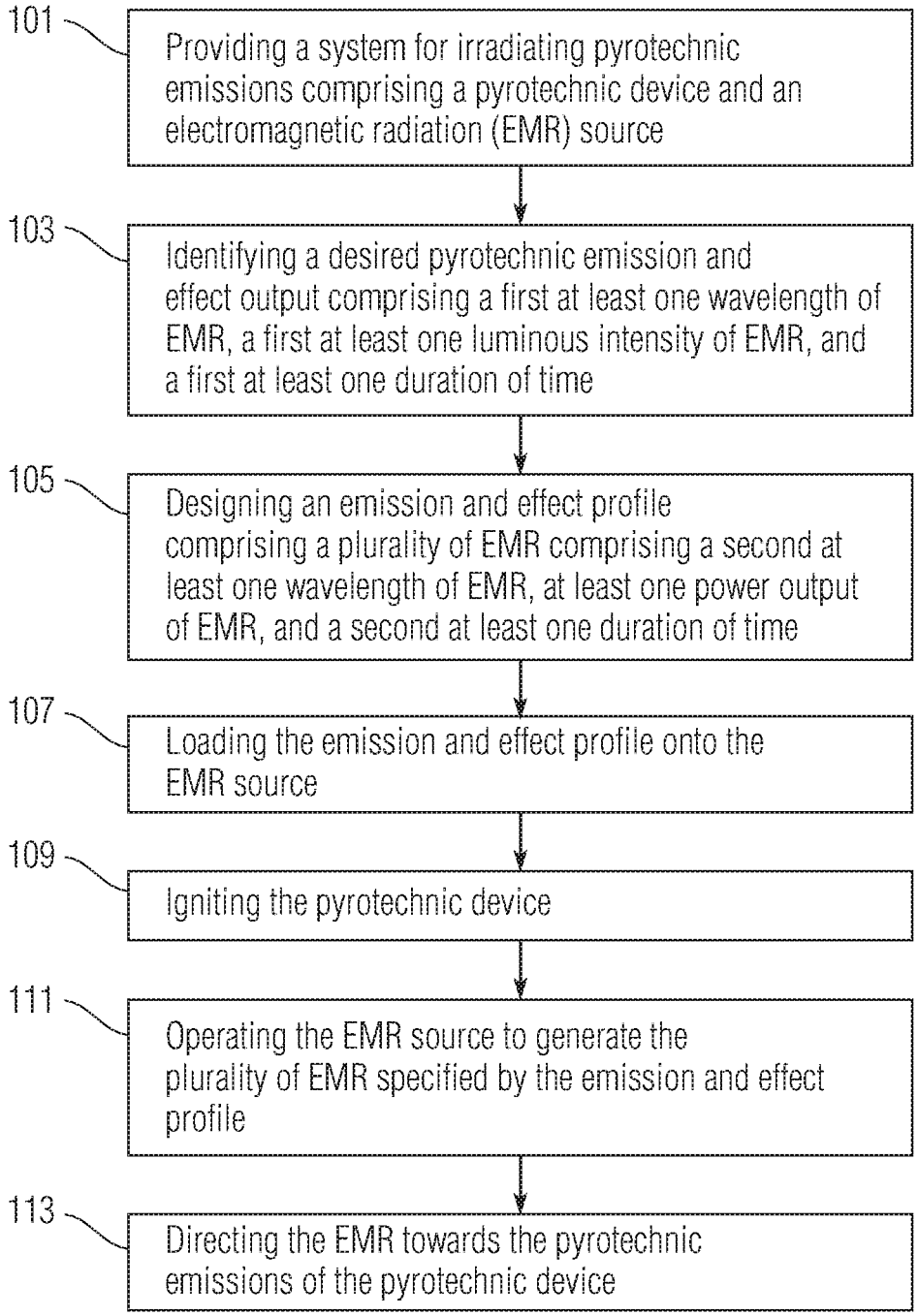
FIG. 7 shows an exemplary method for irradiating pyrotechnic emissions.

FIG. 7 shows an exemplary method of irradiating pyrotechnic emissions. In step 101, a system including a pyrotechnic device (e.g., see 11, FIG. 1) and an EMR source (e.g., see 15, FIG. 1) is provided. In step 103, a desired pyrotechnic emission and effect output is identified, including a first at least one wavelength of EMR (e.g., both 700 nm and 475 nm visible light), a first at least one luminous intensity of EMR (e.g. 100 cd), and a first at least one duration of time (e.g. a 5 second duration, 200 cycles of 5 ms with 10 ms between each cycle). In step 105, an emission and effect profile, including a second at least one wavelength of EMR (e.g., 2.45 GHz), at least one power output of EMR (e.g. 1 kW), and a second at least one duration of time, is designed such that irradiating the pyrotechnic emissions of a pyrotechnic device with the emission and effect profile will create the desired pyrotechnic emission and effect output. In step 107 the emission and effect profile is loaded onto the EMR source (e.g., see 15, FIG. 1) (e.g. uploading the profile to a storage medium (e.g., see 65, FIG. 6)). In step 109, the pyrotechnic device (e.g., see 11, FIG. 1) is ignited. In step 111, the said EMR source is operated (e.g. by human control, by automatic programming) to generate EMR according to the emission and effect profile. In step 113, the EMR is directed (e.g. a human manually changing the trajectory of a laser by moving the EMR source (e.g., see 15, FIG. 1), a processor (e.g., see 63, FIG. 6) controlling an automated directional control mechanism to shift an RF transmitter) towards the pyrotechnic emissions. In an exemplary embodiment, at step 101 a user provides a pyrotechnic device (e.g., see 11, FIG. 1) with a pyrotechnic composition including Mg/PTFE, wherein the said pyrotechnic device normally releases emissions with primary wavelengths between 600 nm and 800 nm. At step 103, a user identifies a desired output wavelength of about 400 nm. At step 105, the user creates a pyrotechnic emission and effect profile including a 1 kW 2.45 GHz microwave, which will turn the non-irradiated red/orange pyrotechnic emissions into blue pyrotechnic emissions.

Although the invention has been described in detail with reference to certain preferred embodiments, additional variations and modifications exist within the spirit and scope of the invention as described and defined in the following claims.

The invention claimed is:

1. A system for irradiating pyrotechnic emissions comprising:

a pyrotechnic device comprising a device body and a pyrotechnic composition, wherein the pyrotechnic composition is contained within the device body, wherein igniting the pyrotechnic composition will release pyrotechnic emissions outside of the device body; and an electromagnetic radiation (EMR) source comprising:

a power supply, a user interface configured to allow an operator to input an emission and effect profile comprising a first information set comprising settings for at least one output wavelength of EMR, one output power of EMR, and at least one duration of time, a storage medium configured to store the emission and effect profile, a processor configured to read the emission and effect profile and transfer the first information set to an EMR generator, and the EMR generator configured to generate a first plurality of EMR with the at least one output wavelength and the at least one output power for the at least one duration of time, wherein the EMR generator is further configured to direct the at least one wavelength of the first plurality EMR towards the pyrotechnic emissions of the pyrotechnic device, wherein the EMR source is coupled to the pyrotechnic device.

2. The system of claim 1, the EMR generator comprising an inductive coil with a plurality of loops, wherein the inductive coil is aligned such that the pyrotechnic emissions will pass through the plurality of loops, wherein the inductive coil is electrically coupled to the power supply, wherein passing a current through the inductive coil creates an electromagnetic field along an axis defined by a line connecting the approximate centers of the plurality of loops of the inductive coil, wherein the emission and effect profile further comprises a second information set comprising settings for at least one current, wherein the processor is further configured to read the emission and effect profile and transfer the second information set to the power supply, wherein the power supply is configured to pass at least one current through the inductive coil.

3. The system of claim 2, wherein the inductive coil spirals in a counter-clockwise direction.

4. The system of claim 1, the EMR generator comprising a first and second conductive plate, wherein the power supply is configured to pass a current to the first and second conductive plates such that the first and second conductive plates are electrically coupled to the power supply such that a positive charge will collect on the first conductive plate and a negative charge will collect on the second plate such that an electromagnetic field will form between the two plates, wherein the emission and effect profile further comprises a second information set comprising settings for at least one current, wherein the processor is further configured to read the emission and effect profile and transfer the second information set to the power supply, wherein the power supply is configured to pass at least one current to maintain a voltage across the first and second conductive plates.

5. The system of claim 1, the EMR generator comprising a waveguide comprising a first and second end, wherein the first plurality of EMR enters the first end of the waveguide exits the second end of the waveguide, wherein the second end of the waveguide is positioned such that the first plurality of EMR exiting the second end of the waveguide is directed towards the pyrotechnic emissions.

6. The system of claim 5, wherein the waveguide is a hollow metallic pipe.

7. The system of claim 5, wherein the waveguide is a fiber optic cable.

8. A system for irradiating pyrotechnic emissions comprising:

a pyrotechnic device comprising a device body and a pyrotechnic composition, wherein the pyrotechnic composition is contained within the device body, wherein igniting the pyrotechnic composition will release pyrotechnic emissions outside of the device body; and an electromagnetic radiation (EMR) source comprising:

a power supply;

a tracking sensor system comprising:

at least one EMR sensor configured to detect a first plurality of EMR and generate a plurality of tracking signals comprising tracking information for at least one wavelength of the first plurality of EMR and the direction from which the first plurality of EMR was received;

a directional control system configured to receive a plurality of directional control signals can use the plurality of directional control signals to orient a EMR generator towards the direction identified by a plurality of tracking signals;

a user interface configured to allow an operator to input an emission and effect profile comprising a first information set comprising settings for at least one output wavelength of a second plurality EMR, at least one output power of a second plurality EMR, and at least one duration of time, wherein the user interface is further configured to allow an operator to input a tracking identification profile comprising a second information set comprising at least one tracked wavelength of EMR;

a storage medium configured to store the emission and effect profile and the tracking identification profile;

a processor configured to compare the plurality of tracking signals to the tracking identification profile from the storage medium, generate the plurality of directional control signals if the first plurality of EMR matches the second information set, and transfer the directional control signals to the directional control system, wherein the processor is further configured to generate a plurality of output EMR signals matching the first information set if the first plurality of EMR matches the second information set and transfer the plurality of output signals to the EMR generator; and the EMR generator configured to generate the at least one output wavelength of the second plurality of EMR at the at least one output power for the at least one duration of time based on the emission and effect profile.

9. The system of claim 8, wherein the EMR generator comprises a microwave antenna.

10. The system of claim 8, wherein the EMR generator comprises a RF antenna.

11. A method of irradiating pyrotechnic emissions comprising:

providing a system for irradiating pyrotechnic emissions comprising:

a pyrotechnic device and an electromagnetic radiation (EMR) source identifying a desired pyrotechnic emission and effect output comprising a first at least one wavelength of EMR, a first at least one intensity of EMR, and a first at least one duration of time, designing an emission and effect profile comprising a plurality of EMR comprising a second at least one wavelength of EMR, a second at least one intensity of EMR, and a second at least one duration of time to create the desired pyrotechnic emission and effect output, loading the emission and effect profile onto the EMR source, igniting the pyrotechnic device, operating the EMR source to generate the plurality of EMR specified by the emission and effect profile, and directing the plurality of EMR towards the pyrotechnic emissions.

12. The method of claim 11, wherein the EMR source is coupled to the system for irradiating pyrotechnic emissions.

13. A method of irradiating pyrotechnic emissions comprising:

providing a system for irradiating pyrotechnic emissions comprising:

a pyrotechnic device comprising a device body and a pyrotechnic composition, wherein the pyrotechnic composition is contained within the device body, wherein igniting the pyrotechnic composition will release pyrotechnic emissions outside of the device body;

a first electromagnetic radiation (EMR) source comprising:

a first power supply;

a tracking sensor system comprising:

at least one EMR sensor configured to detect a first plurality of EMR and generate a plurality of tracking signals comprising tracking information for at least one wavelength of the first plurality of EMR and the direction from which the first plurality of EMR was received;

a directional control system configured to receive a plurality of directional control signals can use the plurality of directional control signals to orient a first EMR generator towards the direction identified by a plurality of tracking signals;

a first user interface configured to allow an operator to input a first emission and effect profile comprising a first information set comprising settings for a first at least one output wavelength of a second plurality EMR, a first at least one output power of a second plurality EMR, and a first at least one duration of time, wherein the user interface is further configured to allow an operator to input a tracking identification profile comprising a second information set comprising at least one tracked wavelength of EMR;

a first storage medium configured to store the first emission and effect profile and the tracking identification profile;

a first processor configured to compare the plurality of tracking signals to the tracking identification profile from the first storage medium, generate the plurality of directional control signals if the first plurality of EMR matches the second information set, and transfer the directional control signals to the directional control system, wherein the processor is further configured to generate a first plurality of output EMR signals matching the first information set if the first plurality of EMR matches the second information set and transfer the first plurality of output signals to the first EMR generator; and the first EMR generator configured to generate the at least one output wavelength of the second plurality of EMR at the at least one output power for the at least one duration of time based on the first emission and effect profile; a second EMR source comprising:

a second power supply;

a second user interface configured to allow an operator to input a second emission and effect profile comprising a third information set comprising settings for a second at least one output wavelength of a third plurality of EMR, a second at least one output power of a third plurality of EMR, and a second at least one duration of time;

a second storage medium configured to store the second emission and effect profile;

a second processor configured to read the second emission and effect profile and transfer the third information set to a second EMR generator; and the second EMR generator configured to generate the third plurality of EMR with the second at least one output wavelength and the second at least one output power for the second at least one duration of time;

wherein the second EMR generator is further configured to direct third plurality EMR towards the pyrotechnic emissions of the pyrotechnic device;

wherein the second EMR source is coupled to the pyrotechnic device;

identifying a desired pyrotechnic emission and effect output comprising a first at least one wavelength of EMR, a first at least one intensity of EMR, and a first at least one duration of time;

designing an emission and effect profile comprising a plurality of EMR comprising a second at least one wavelength of EMR, a second at least one intensity of EMR, and a second at least one duration of time to create the desired pyrotechnic emission and effect output, loading the emission and effect profile onto the EMR source;

igniting the pyrotechnic device;

operating the EMR source to generate the plurality of EMR specified by the emission and effect profile; and directing the plurality of EMR towards the pyrotechnic emissions.

* * * * *